US005468094A

United States Patent [19]

Vanderpan et al.

[11] Patent Number: 5,468,094

[45] Date of Patent: Nov. 21, 1995

[54] MACHINE WHICH HOLDS TOOLS FOR CLEANING AND FILLING JOINTS IN PAVEMENT

[75] Inventors: Timothy P. Vanderpan; Robert L. Kruger, both of Sioux Falls, S. Dak.

[73] Assignee: Robert L. Kruger, Sioux Falls, S. Dak.

[21] Appl. No.: 102,837

[22] Filed: Aug. 6, 1993

[51] Int. Cl.[6] ..... E01C 23/12

[52] U.S. Cl. ..... 404/75; 404/87; 404/89

[58] Field of Search ..... 404/64, 66, 74, 404/87, 89, 75; 299/36, 37

[56] References Cited

U.S. PATENT DOCUMENTS 4,640,644 2/1987 Puchala et al. ..... 299/36

4,778,304 10/1988 Baldi et al. ..... 404/87

*Primary Examiner*—Ramon S. Britts

*Assistant Examiner*—Pamela A. O'Connor

[57] ABSTRACT

Pavement repair equipment designed to hold sand-blasting hoses or other similar devices to clean joints preparatory to sealing those joints. The equipment is mobile being adapted to be moved by an outside powered device and is adapted to move a sand-blasting nozzle along either a longitudinal or transverse joint in the paved surface and to hold a nozzle adjustable at a plurality of angles to the surface. Other equipment which might be held by the equipment would include vacuum nozzles or sealant applicators.

2 Claims, 6 Drawing Sheets

MACHINE WHICH HOLDS TOOLS FOR CLEANING AND FILLING JOINTS IN PAVEMENT

BACKGROUND AND SUMMARY OF THE INVENTION

This invention pertains to equipment useful in preparing highway pavement joints for sealing and more particularly to a mobile frame carrying a trolley to hold sand blasting equipment or the like at a proper angle to clean joints in highway pavement.

In the usual paved highway having either a concrete or asphaltic surface, the surface is spaced by joints to allow for expansion and contraction of that surface without cracking. These joints typically run longitudinally of the highway between lanes of travel and transversely at regular spaced intervals. The joints are sealed by a material which will continue to seal the joints as they are closed and opened by the expansion or contraction of the slab between the joints.

To be most effective, the sealing material should cling to the edges of the slab to prevent water from collecting in the joints. Particularly in areas where there may be alternate freezing and thawing, the water can cause problems because of the expansion as the water freezes. Thus, freezing water in the joints can cause cracking and spalling at the joint. Further problems can be caused by non-compressible materials falling into the joint when it is at its widest and then being trapped as the joint narrows; and by traffic impact causing cracking and spalling at the joint surface.

All of the problems noted above are present in new pavement particularly— where the sealing is improper—and more severely in older pavement where the sealing has broken down. Thus, it is important that the sealing be adequately done in the first instance and that periodic maintenance of the seal be properly accomplished.

Both initially and during maintenance, the desired conditions are that the edges of the joints be clear so that the sealing material will bond to those edges creating a true seal. Ordinarily, the edges are cleaned by sand blasting.

Currently, most of the sand blasting is done manually by one or more operators carrying sand blasting nozzles connected to a source of compressed air and sand, and directing the nozzle toward the edge of the slab. Because of human error, the possibilities of which may be enhanced by fatigue, the direction of the nozzle and the speed of advance of the nozzle is rarely either uniform or adequate. Accurate angles of direction of the nozzles are usually specified by highway authorities and those angles are difficult to judge accurately by operators. Dust from the operation may also cause serious health problems for operators who must necessarily stand very close to the nozzle as the sand is emitted.

The present invention obviates many of the problems. By holding the nozzles mechanically at a fixed adjusted angle, the specification of that angle can be readily met. By using a remote control for the movement of the nozzles the operator can be somewhat isolated from the source of dust resulting in a lessened health hazard. By using a mechanical device, a more smooth and regular movement of the nozzles along the joint is assured thus making certain that no area is missed, and that less of the sand blasting is misdirected at areas other than the edge of the slab.

DESCRIPTION

Figure 1:
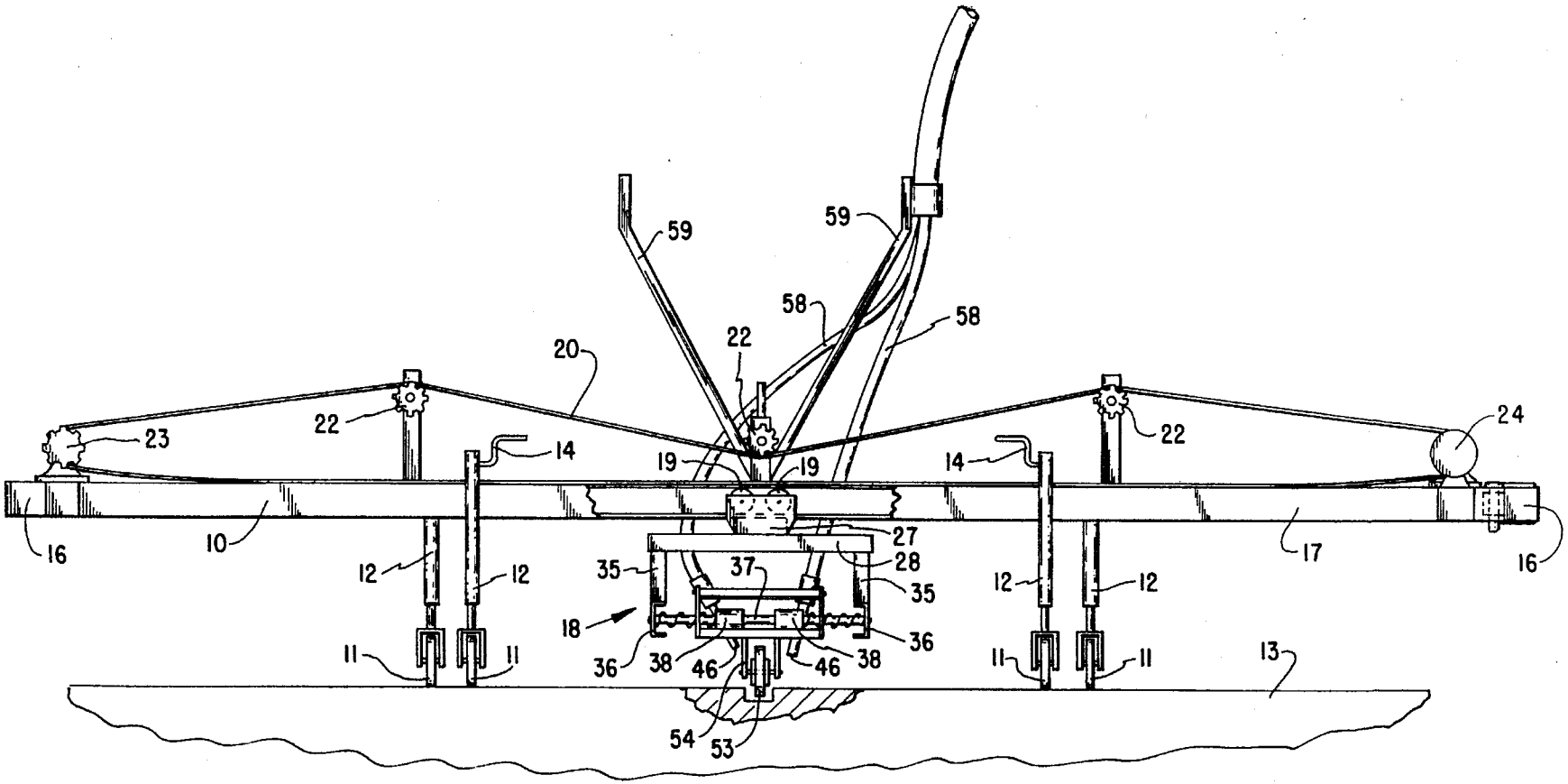
FIG. 1 is a front elevational view of the device in position to be operated longitudinally of a pavement.

Briefly this invention comprises a mobile frame having an attached carriage adapted to carry directed nozzles either in the direction of the movement of the frame or laterally thereof. The nozzles are adjustable to provide sand blasting at a given angle to the surface over which the frame moves.

In this application, the originally designed device will be described first. The preferred embodiment of the invention will be described later as an alternative. The differences between the devices will be apparent from their respective descriptions.

Referring to the drawings, the original device includes a principal frame 10 mounted on castering wheels 11 at the ends of posts 12. The wheels are adapted to support the frame from the pavement surface 13. Because that surface may be sloped or have a crown, some length adjustment in the post 12 may be provided to be controlled by a crank 14 or the like. Thus, the frame can be levelled or properly adjusted for contacting the pavement as may be necessary.

The frame is elongated in a direction transverse of the direction of travel. A rear member 15 is bolted to a pair of end bars 16 which, in turn, are fixed to a pair of track members 17. A carriage 18 is mounted on wheels 19 rolling on the track members 17 so that the carriage can roll from one side to the other of the frame. Chains 20 are attached to the carriage and are guided and held in tension sprockets or idler sprockets 22 and an end sprocket 23. A motor 24, preferably a hydraulic motor because the hydraulic power will ordinarily be readily available, is provided to move the chain thereby controlling transverse movement of the carriage.

Figure 3:
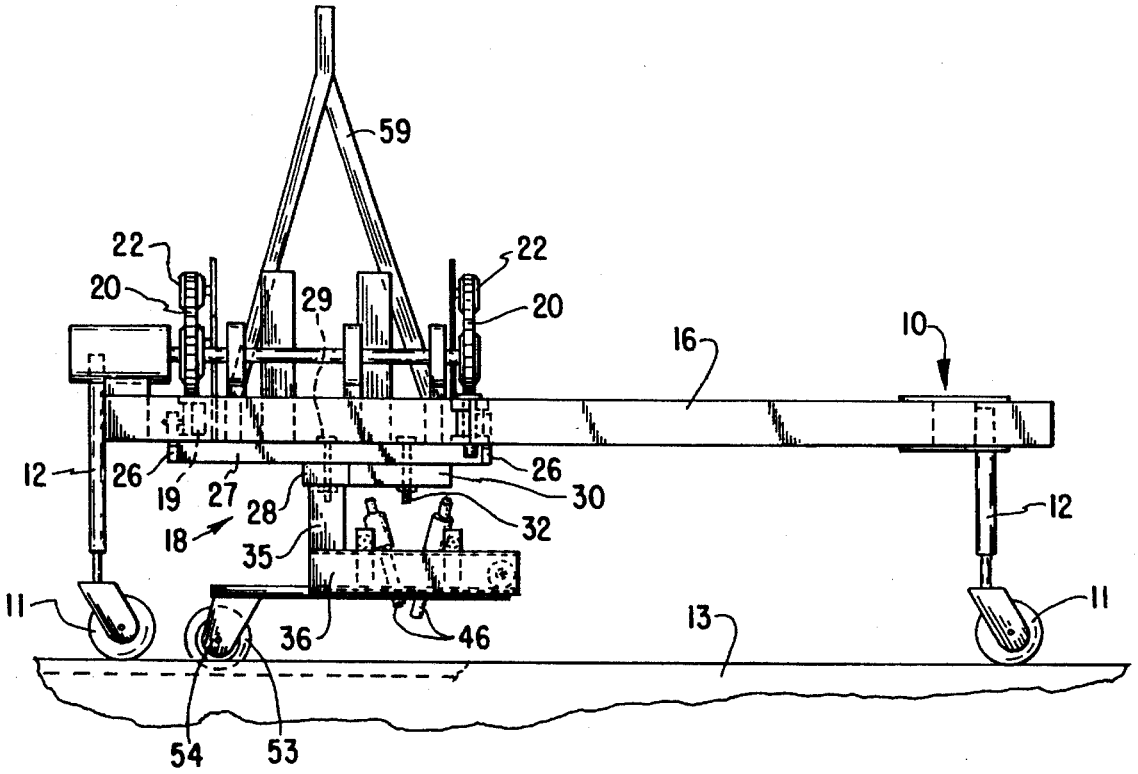
FIG. 3 is an end elevational view of the device shown in FIGS. 1 and 2.
Figure 5:
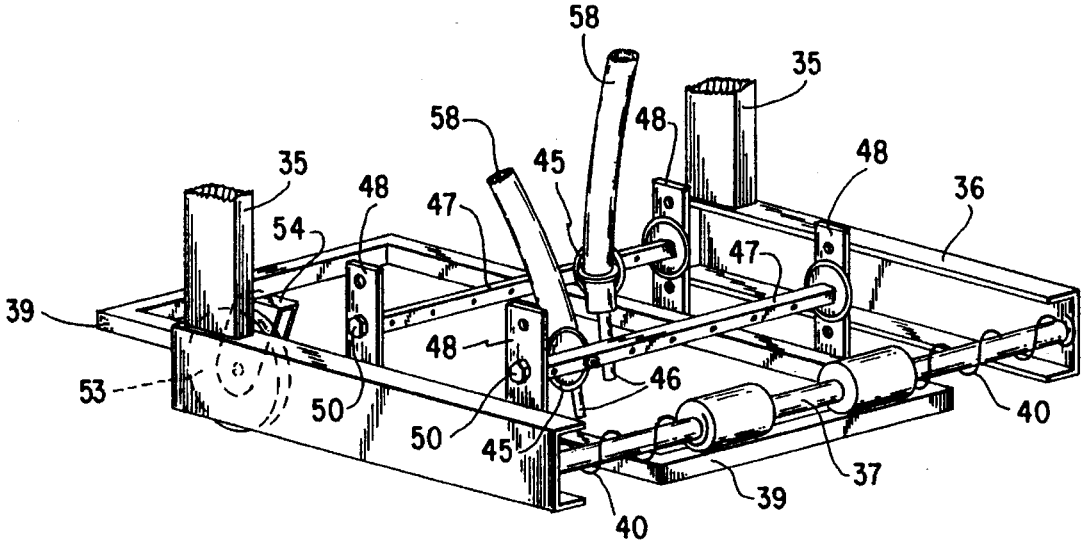
FIG. 5 is a perspective view of the operating carriage of the device.
Figure 4:
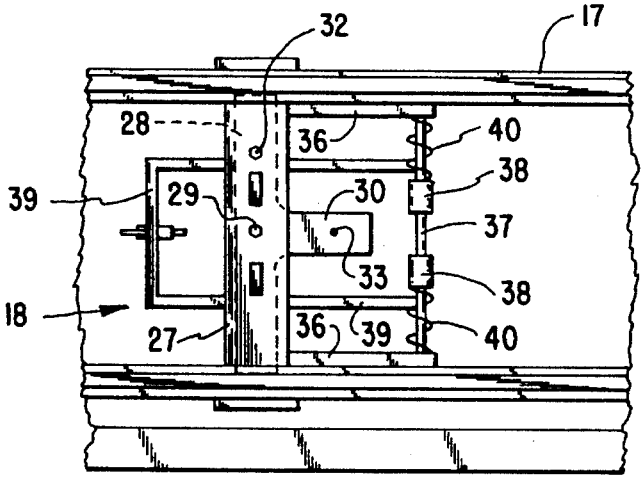
FIG. 4 is a top plan view of the carriage turned for transverse use and apart from the carrying frame.

The carriage 18 includes a pair of hangers 26 which extend downward from the wheels 19 and carry a plate 27 extending between the hangers (FIG. 3). A cross member 28 is pivoted to the plate 27 on a vertical axis by a bolt 29 or similar device. The cross member 28 is T-shaped having a leg 30 extending at a right angle from the main part of the member. Thus, in order to hold the plate 28 from pivoting around the axle 29, a pin or bolt 32 may be slipped through an opening in the plate 27 and a corresponding opening 33 in either the main part of the cross member 28 or its leg 30.

The holding devices for the nozzles are carried on a framework suspended from the T-shaped member 28 on side supports 35 and include side members 36. An axle 37 extends between these side members to complete a rectangular frame. Bearing members 38 are fixed to a rectangular carrier frame 39 and are journalled on the axle 37 both pivotally and slidably. Thus, the frame 39 can pivot about the axle 37 and can slide axially along the axle. In order to hold the carrier frame normally centered, a pair of compression springs 40 are engaged between the side members 36 and the bearing members 38 on both sides, thus opposing each other to hold the frame 39 approximately centered.

Holders 45 for the sand blasting nozzles 46 are fastened to spaced parallel cross members 47. These cross members are carried by the frame 39 on vertical posts 48 fixed to the frame 39. The cross members 47 and therefore the nozzles may be vertically adjustable by provision of a series of vertically spaced holes 49 in the post 48 through which bolts 50 can be run into the ends of the cross members 47. The holders 45 are also adjustable as to the angles at which the nozzles are directed. This adjustment may be held springably in position so long as the springs are relatively stiff so that the nozzle will be firmly held.

Because not all joints in pavement are uniformly straight, and because it is not always possible to move the principal frame 10 in a precise manner, the carrier frame 39 is made slidable on the axle 37 as described. In order to position the frame on that axle, a guide wheel or disc 53 is journalled on a fork 54 on the frame. As shown in FIGS. 1 and 3, this wheel 53 is adapted to run between the edges of the joint, and thus will control lateral movement of the frame 39 to assure proper positions for the nozzles 46. It will be seen that the springs 40 should be properly proportioned so as not to interfere greatly with the sliding movement along the axle 37 but still to be effective to center the carrier frame 39. Then, the wheel 53 by following the groove of the joint will keep the nozzles 46 properly directed.

The use of the device will be apparent. To clean the longitudinal joints in a concrete pavement, the T-shaped member 28 is aligned so that the wheel 53 will follow that joint. The principal frame 10 is set essentially transversely of the road with the carriage 18 near the center of the frame although that lateral position can be adjusted by use of the motor 24 and chains. After placement, some motive power can be arranged to push the device down the street or road while the sand and compressed air is directed through hoses 58. These hoses may be held by a support device 59, and lead from a compressor and mixing unit well known in the art and not shown here. The latter units may be carried or pulled by the motive unit. The motive unit used and preferred by the inventors is a skid-steered loader whose bucket attachments fit nicely under the rear track member 17 and thus can push the device and steer it somewhat because the wheels 11 are castering wheels in the posts 12.

For use transversely of the road, the T-shaped member 28 is rotated 90 degrees on the plate 27 and pinned in the new position. The principal frame 10 is then placed over the transverse joint so that the guide wheel 53 can follow that joint. Then the motor 24 is actuated to pull the device transversely by the chains 20 while the nozzles are directing the blasting sand into the groove.

Figure 2:
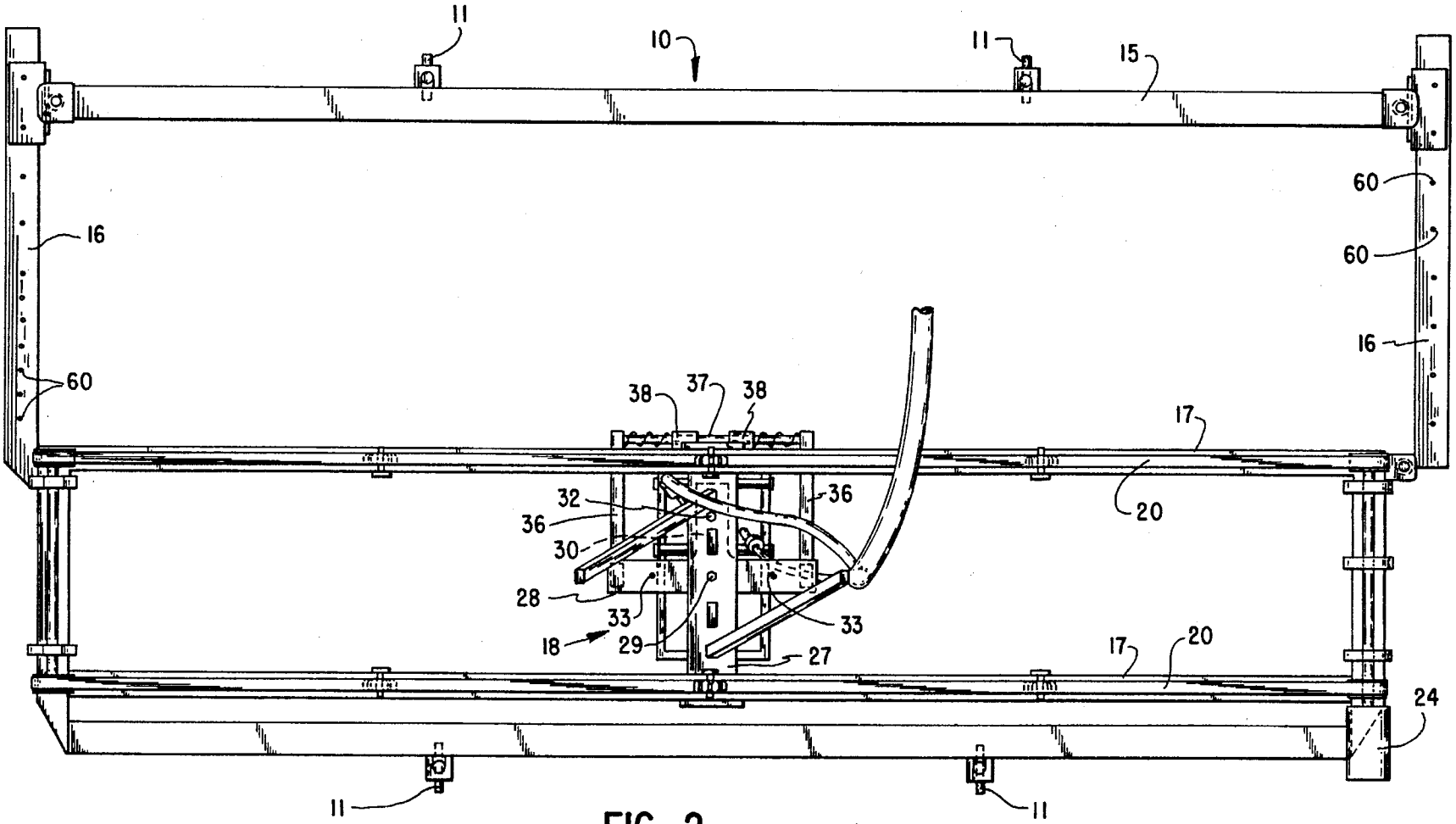
FIG. 2 is a top plan view of the device shown in FIG. 1.

For skewed transverse joints which are now sometimes used, the principal frame 10 can be somewhat adjusted to a skewed position. FIG. 2 illustrates a series of holes 60 in the side members 16. By differentially fixing the rear members 15 into holes not directly opposite each other on the side members 16, the framework can be set somewhat diagonally to match the angle of the joints. Then the carriage 18 will be able to follow the skewed joint.

It will be obvious to those skilled in the art that the device can be used not only to hold sand blasting nozzles but also to hold such devices as sealant placement nozzles to stuff the joint with tar or the like or to hold a vacuum nozzles to draw dirt and debris from the joint. A simple adaptation could also be made to perform two or more of these functions with a single pass over the joint.

Figure 6:
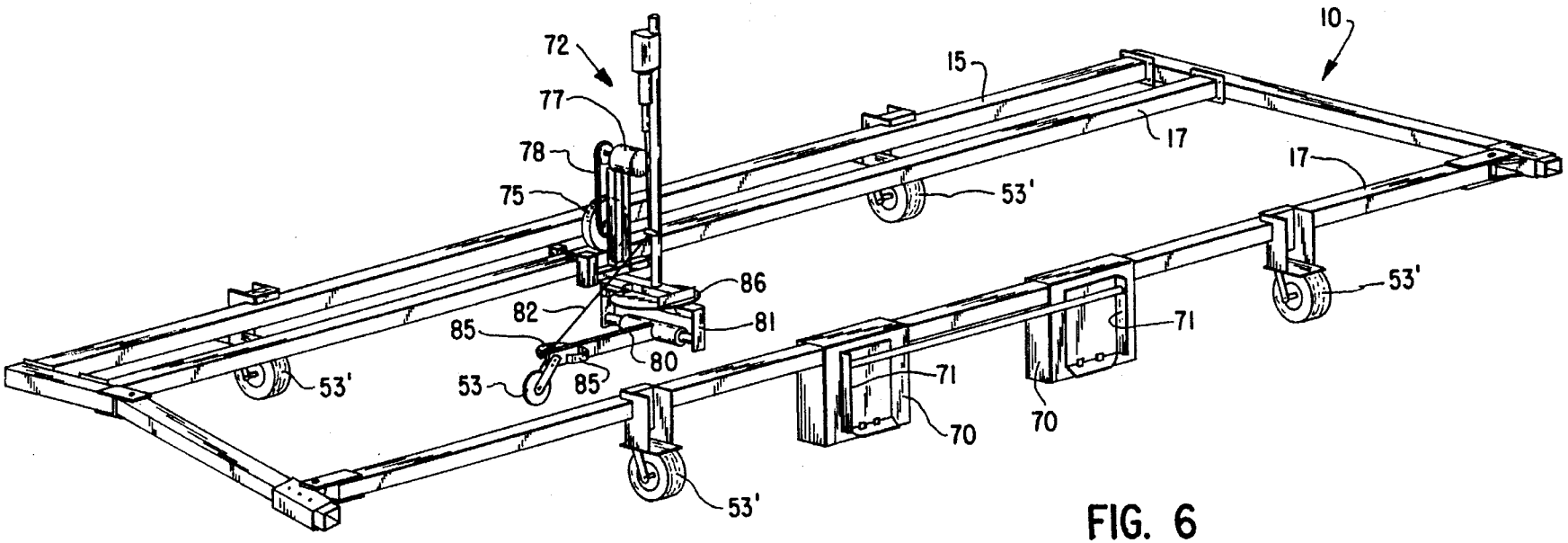
FIG. 6 is a perspective view of an alternative and improved embodiment of the device.
Figure 7:
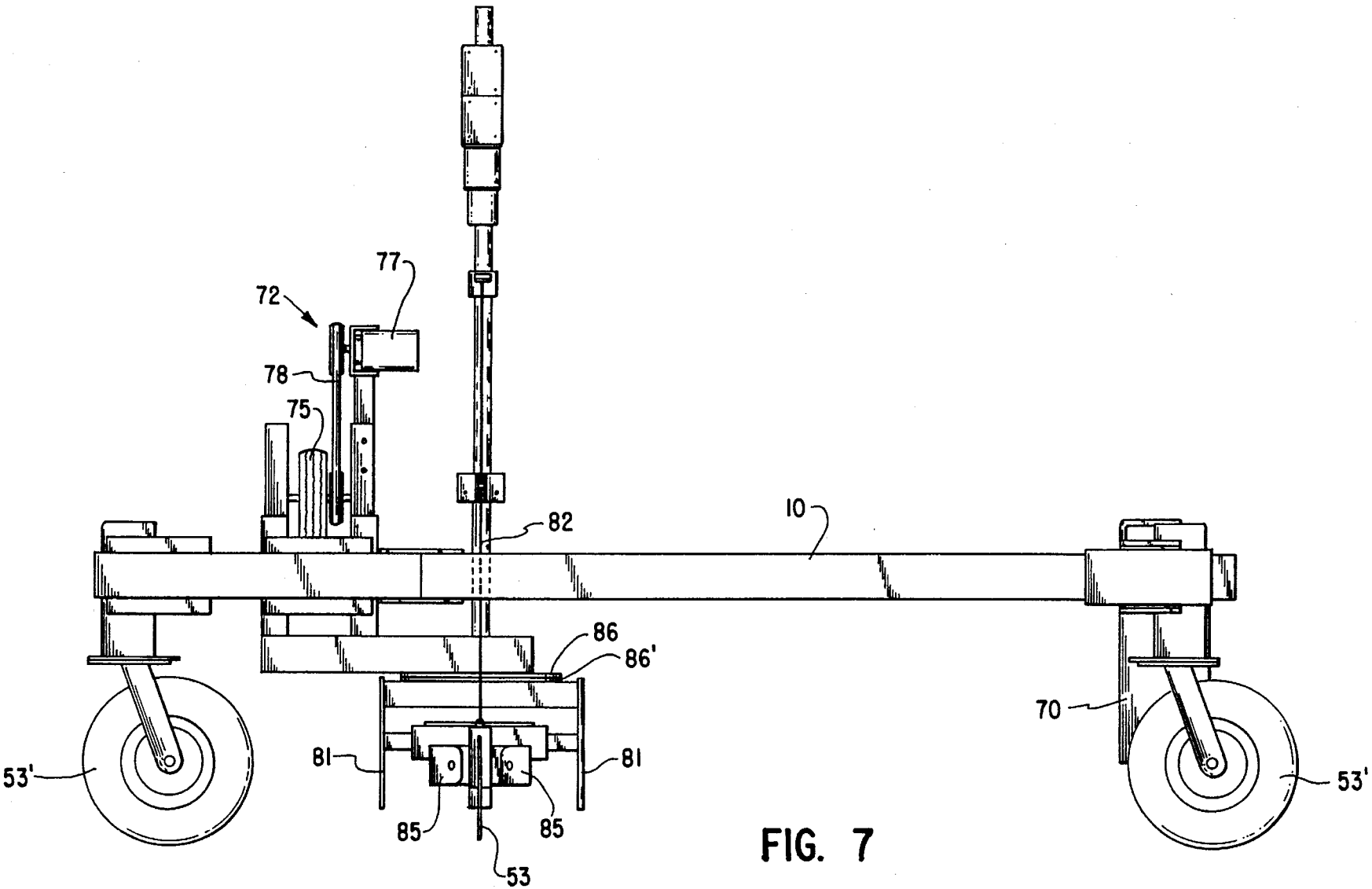
FIG. 7 is an end elevational view of the device of FIG. 6.

An alternative embodiment of our invention is illustrated in FIGS. 6 and 7. This alternative illustrates several refinements in the original embodiment to enhance safety and ease of operation. The base frame 10 is essentially the same as that of the original embodiment. However, instead of hard-tired wheels 53, the present device is mounted on pneumatic tired wheels 53'. For more positive steering and control, the frame in this embodiment is provided with a pair of socket members 70 attached to the rear frame member 17. These socket members are formed with an opening 71 into which the tines of a forklift machine may be inserted. Thus the forklift device will be able readily to steer and to control the direction and elevation of the entire device.

A more important improvement is in the carriage and its lateral transport mechanism. The original device used coordinated chain mechanisms to pull the carriage along the frame. In this improved device, the carriage 72 is slidably journalled on only one of the track members 17. A pneumatic-tired wheel 75 assists in the support of the carriage on the track 17. The pressure of this support also generates considerable friction between the tire 75 and the track 17. Thus, rotation of the tire can cause the lateral movement of the carriage.

To control that lateral movement, a motor 77 may be used to drive the wheel through a chain or belt 78. Because there is no extensive length of chain or the like exposed as there is in the originally detailed embodiment, this latter described structure is much safer than the original. Further, guards can readily be used over the belt 78 to assure added safety.

A simplified mode of control of the guide wheel 53 may also be used. In the new embodiment this wheel 53 or disc is mounted on an outer end of an arm 80 journalled at its outer end in an ear 81 on the carriage. In order to raise or lower the wheel 53, a cable 82 or the like is fastened to the same end of the arm 80 as holds the wheel 53 and at the other end to an elevating device 83 adapted to pull the cable 82 to raise the arm 80. The weight of the arm 80 and wheel 53 is adequate to lower the device when the cable 82 is relaxed.

The arm 80 also supports a pair of sockets 85 into which the sand blasting nozzles 46 (FIG. 1) can be placed for holding. This arrangement is not as accurate as that described previously, and if accuracy is important, the first described device may be preferred. However, for most applications, the sockets can be closely enough fitted to the nozzles that the angles will comply with the specified tolerance.

In the improved device, the turning of the nozzles holding and guiding mechanism is done between plates 86 and 86' instead of between the plate 27 and the leg 30 as previously. However, the action is similar in both embodiments.

Thus, while the action is similar and the results are the same, the latter described embodiment is somewhat simpler and safer than that first described.

I claim as my invention:

1. A portable carrier for controlling the position of tools and sand blasting nozzles for cleaning and filling joints in pavement comprising a frame adapted to be moved over said pavement, carriage means movably mounted on said frame adapted to move on said frame transversely of said pavement, and holding means on said carriage adapted to hold said nozzle in a position directed toward said joint, said holding means including a holding frame slidably mounted relative to said carriage means, a guide wheel adapted to run in said joint, said guide wheel being mounted on fork means, said fork means being slidable on an axle on said carrier frame and spring means engaged with said bracket means to bias said bracket means to the center of said axle.

2. A portable carrier for controlling the position of tools and sand blasting nozzles for cleaning and filling joints in pavement, said carrier comprising a frame mounted on wheels adapted to roll longitudinally of said pavement, said frame being elongated in a direction normally transverse of said pavement, carriage means mounted on said frame for movement on said frame in the elongated direction, holding means on said carrier means including a frame work pivoted on a vertical axis relative to said carriage means, said framework including an axle normally adapted to lie substantially perpendicular to said joint, a nozzle holding frame slidably and pivotally mounted on said axle, said nozzles being held on said holding frame, and spring means engaging said holding frame near said axle, said spring means being effective to bias said holding frame toward the center of said axle.

* * * * *